United States Patent [19]

Datta et al.

[11] 4,321,090

[45] Mar. 23, 1982

[54] MAGNETIC AMORPHOUS METAL ALLOYS

[75] Inventors: Amitava Datta, Mendham; Nicholas J. DeCristofaro, Chatham, both of N.J.

[73] Assignee: Allied Corporation, Morristown, N.J.

[21] Appl. No.: 127,714

[22] Filed: Mar. 6, 1980

[51] Int. Cl.[3] ..... C22C 33/00

[52] U.S. Cl. ..... 75/123 B; 75/123 L; 75/123 K; 148/31.55

[58] Field of Search ..... 148/31.55, 31.57, 103, 148/108; 75/123 B, 123 K, 123 L

[56] References Cited

U.S. PATENT DOCUMENTS

| | | | |
|---|---|---|---|
| Re. 29,989 | 5/1979 | Polk et al. | 75/122 |
| 3,856,513 | 12/1974 | Chen et al. | 75/122 |
| 4,056,411 | 11/1977 | Chen et al. | 75/122 |
| 4,079,430 | 3/1978 | Fujishima et al. | 360/126 |
| 4,116,682 | 9/1978 | Polk et al. | 75/123 K |
| 4,116,728 | 9/1978 | Becker et al. | 148/108 |
| 4,187,128 | 2/1980 | Billings et al. | 148/101 |
| 4,197,146 | 4/1980 | Frischmann | 148/108 |
| 4,226,619 | 10/1980 | Hatta et al. | 75/123 B |

*Primary Examiner*—L. Dewayne Rutledge
*Assistant Examiner*—John P. Sheehan
*Attorney, Agent, or Firm*—Ernest D. Buff; Gerhard H. Fuchs

[57] ABSTRACT

An amorphous metal alloy wish is at least 90 percent amorphous having enhanced magnetic properties and consisting essentially of a composition having the formula $Fe_aCo_bB_cSi_d$, wherein "a", "b", "c" and "d" are atomic percentages ranging from about 64.0 to 80.0, 7.0 to 20.0, 13.0 to 15.0 and greater than zero to 1.5, respectively, with the proviso that the sum of "a", "b", "c" and "d" equals 100.

5 Claims, No Drawings

MAGNETIC AMORPHOUS METAL ALLOYS

DESCRIPTION

BACKGROUND OF THE INVENTION

1. Field of the Invention

The invention relates to amorphous metal alloy compositions and, in particular, to amorphous alloys containing iron, cobalt, boron and silicon having high saturation induction and enhanced dc and ac magnetic properties at high induction levels.

2. Description of the Prior Art

Investigations have demonstrated that it is possible to obtain solid amorphous materials from certain metal alloy compositions. An amorphous material substantially lacks any long-range atomic order and is characterized by an X-ray diffraction profile consisting of broad intensity maxima. Such a profile is qualitatively similar to the diffraction profile of a liquid or ordinary window glass. This is in contrast to a crystalline material which produces a diffraction profile consisting of sharp, narrow intensity maxima.

These amorphous materials exist in a metastable state. Upon heating to a sufficiently high temperature, they crystallize with evolution of the heat of crystallization, and the X-ray diffraction profile changes from one having amorphous characteristics to one having crystalline characteristics.

Novel amorphous metal alloys have been disclosed by H. S. Chen and D. E. Polk in U.S. Pat. No. 3,856,513 issued Dec. 24, 1974. These amorphous alloys have the formula $M_aY_bZ_c$, where M is at least one metal selected from the group of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. These amorphous alloys have been found suitable for a wide variety of applications in the form of ribbon, sheet, wire, powder, etc. The Chen and Polk patent also discloses amorphous alloys having the formula $T_iX_j$, where T is at least one transition metal, X is at least one element selected from the group consisting of aluminum, antimony, beryllium, boron, germanium, carbon, indium, phosphorus, silicon and tin, "i" ranges from about 70 to 87 atom percent and "j" ranges from about 13 to 30 atom percent. These amorphous alloys have been found suitable for wire applications.

Iron-cobalt-boron amorphous alloys with high saturation induction have been disclosed by R. C. O'Handley, C. -P. Chou and N. J. DeCristofaro in Journal of Applied Physics 50 (5), 1979 pp. 3603–3607.

At the time that the amorphous alloys described above were discovered, they evidenced magnetic properties that were superior to then known polycrystalline alloys. Nevertheless, new applications requiring improved magnetic properties and higher thermal stability have necessitated efforts to develop additional alloy compositions.

SUMMARY OF THE INVENTION

In accordance with the present invention, there is provided a metal alloy which is at least 90% amorphous consisting essentially of a composition having the formula $Fe_aCo_bB_cSi_d$, wherein "a" ranges from about 64 to 80 atom percent, "b" ranges from about 7 to 20 atom percent, "c" ranges from about 13 to 15 atom percent and "d" ranges from greater than zero to about 1.5, with the proviso that the sum of "a", "b", "c" and "d" equals 100.

The subject alloys are at least 90 percent amorphous and preferably at least 97 percent amorphous, and most preferably 100 percent amorphous, as determined by X-ray diffraction. The alloys are fabricated by a known process which comprises forming a melt of the desired composition and quenching at a rate of at least about $10^{5°}$ C./sec by casting molten alloy onto a rapidly rotating chill wheel.

In addition, the invention provides a method of enhancing the magnetic properties of a metal alloy which is at least 90 percent amorphous consisting essentially of a composition having the formula $Fe_aCo_bB_cSi_d$, wherein "a", "b", "c" and "d" are atomic percentages ranging from about 64 to 80, 7 to 20, 13 to 15 and greater than zero to 1.5, respectively, with the proviso that the sum of "a", "b", "c" and "d" equals 100, which method comprises the step of annealing the amorphous metal alloy.

Further, the invention provides a core for use in an electromagnetic device; such core comprising a metal alloy which is at least 90 percent amorphous consisting essentially of a composition having the formula $Fe_aCo_bB_cSi_d$, wherein "a", "b", "c" and "d" are atomic percentages ranging from about 64 to 80, 7 to 20, 13 to 15 and greater than zero to 1.5, respectively, with the proviso that the sum of "a", "b", "c" and "d" equals 100.

The alloys of this invention exhibit high saturation induction and improved ac and dc magnetic properties at high induction levels. As a result, the alloys are particularly suited for use in power transformers, current transformers and airborne transformers, pulse transformers in laser applications.

Compared to iron-cobalt-boron amorphous alloys, the compositions described herein are more easily quenched into ribbon with uniform dimensions and properties. The subject alloys demonstrate increased crystallization temperatures and improved thermal stabilities. As such, they are more easily field annealed to develop optimum magnetic properties.

DETAILED DESCRIPTION OF THE INVENTION

The composition of the new amorphous Fe-Co-B-Si alloy, in accordance with the invention, consists of 64 to 80 atom percent iron, 7 to 20 atom percent cobalt, 13 to 15 atom percent boron and greater than zero to 1.5 atom percent silicon. Such compositions exhibit high saturation induction and enhanced dc and ac magnetic properties at high induction levels. The improved magnetic properties are evidenced by high magnetization, low core loss and low volt-ampere demand. A preferred composition within the foregoing ranges consists of 67 atom percent iron, 18 atom percent cobalt, 14 atom percent boron and 1.0 atom percent silicon.

The alloys of the present invention are at least about 90 percent amorphous and preferably at least about 97 percent amorphous and most preferably 100 percent amorphous. Magnetic properties are improved in alloys possessing a greater volume percent of amorphous material. The volume percent of amorphous material is conveniently determined by X-ray diffraction.

The amorphous metal alloys are formed by cooling a melt at a rate of about $10^{5°}$ to $10^{6°}$ C./sec. The purity of all materials is that found in normal commercial practice. A variety of techniques are available for fabricating splat-quenched foils and rapid-quenched continuous ribbons, wire, sheet, etc. Typically, a particular composition is selected, powders or granules of the requisite elements (or of materials that decompose to form the elements, such as ferroboron, ferrosilicon, etc.) in the desired proportions are melted and homogenized, and the molten alloy is rapidly quenched on a chill surface, such as a rotating cylinder.

The alloys of the present invention have an improved processibility as compared to other low metalloid iron-based metallic glasses.

The magnetic properties of the subject alloys can be enhanced by annealing the alloys. The method of annealing generally comprises heating the alloy to a temperature sufficient to achieve stress relief but less than that required to initiate crystallization, cooling the alloy, and applying a magnetic field to the alloy during the heating and cooling. Generally, a temperature range of about 250° C. to 400° C. is employed during heating, with temperatures of about 270° C. to 370° C. being preferred.

As discussed above, the alloys of the present invention exhibit improved magnetic properties at high induction levels. For a given transformer power capacity, the higher the operating induction level of the core, the smaller the transformer. This weight savings is especially important in airborne applications.

When cores comprising the subject alloys are utilized in electromagnetic devices, such as transformers, they evidence high magnetization, low core loss and low volt-ampere demand, thus resulting in more efficient operation of the electromagnetic device. The loss of energy in a magnetic core as the result of eddy currents, which circulate through the core, results in the dissipation of energy in the form of heat. Cores made from the subject alloys require less electrical energy for operation and produce less heat. In applications where cooling apparatus is required to cool the transformer cores, such as transformers in aircraft and large power transformers, an additional savings is realized since less cooling apparatus is required to remove the smaller amount of heat generated by cores made from the subject alloys. In addition, the high magnetization and high efficiency of cores made from the subject alloys result in cores of reduced weight for a given capacity rating.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE I p In order to demonstrate the enhanced thermal stability of the iron-cobalt-boron-silicon alloys of the present invention, crystallization temperatures were determined by differential scanning calorimetry in an argon atmosphere using a 20° C./min heating rate. Crystallization temperatures for a number of alloy compositions that are within and outside the scope of the present invention are respectively shown in Table I and Table II. As shown by the data in Tables I and II, alloys within the scope of the present invention have higher crystallization temperatures than those outside the scope of the invention and, therefore, are more stable thermally.

TABLE I

CRYSTALLIZATION TEMPERATURES FOR AMORPHOUS METAL ALLOYS WITHIN THE SCOPE OF THE INVENTION

| Example | | Composition Fe | Co | B | Si | Crystallization Temperature |
|---|---|---|---|---|---|---|
| 1 | at. % | 75 | 10 | 14 | 1 | 430° C. |
| | wt. % | 84.5 | 11.9 | 3.0 | .6 | |
| 2 | at. % | 67 | 18 | 14 | 1 | 432° C. |
| | wt. % | 75.1 | 21.3 | 3.0 | .6 | |

TABLE II

CRYSTALLIZATION TEMPERATURES FOR AMORPHOUS METAL ALLOYS OUTSIDE THE SCOPE OF THE INVENTION

| Example | | Composition Fe | Co | B | Si | Crystallization Temperature |
|---|---|---|---|---|---|---|
| 1 | at. % | 75 | 10 | 15 | 0 | 403° C. |
| | wt. % | 84.8 | 11.9 | 3.3 | — | |
| 2 | at. % | 69 | 16 | 15 | 0 | 404° C. |
| | wt. % | 77.7 | 19.0 | 3.3 | — | |

EXAMPLE II

Toroidal test samples were prepared by binding approximately 0.020 kg 0.0125 m wide alloy ribbon of various compositions containing iron, cobalt, boron and silicon on a steatite core, having inside and outside diameters of 0.0397 m and 0.0445 m, respectively. One hundred and fifty turns of high temperature magnetic wire were wound on the toroid to provide a dc circumferential field of 1591.6 ampere-turn/meters for annealing purposes. The samples were annealed in an inert gas atmosphere for one hour at 270° C., followed by a ten minute hold at 360° C. with the 1591.6 A/m field applied during heating and cooling. The samples were heated and cooled at rates of about 10° C./min.

The dc magnetic properties, i.e., coercive force ($H_c$) and remanent magnetization at zero A/m ($B_0$) and at eighty A/m ($B_{80}$), of the samples were measured by a hysteresisgraph. The ac magnetic properties, i.e., core loss (watts/kilogram) and RMS volt-ampere demand (RMS volt-amperes/kilogram), of the samples were measured at a frequency of 400 Hz and a magnetic intensity of 1.6 tesla by the sine-flux method.

Field annealed dc and ac magnetic values for a variety of alloy compositions that are within the scope of the present invention are shown in Table III.

TABLE III

FIELD ANNEALED DC AND AC MAGNETIC MEASUREMENTS FOR AMORPHOUS METAL ALLOYS WITHIN THE SCOPE OF THE INVENTION

| Example | | Composition Fe | Co | B | Si | dc $H_c$ (A/m) | $B_O$ (T) | $B_{80}$ (T) | 400 Hz ac at 1.6T Core Loss (watt/kg) | Exciting Power (VA/kg) |
|---|---|---|---|---|---|---|---|---|---|---|
| 1 | at. % | 75 | 10 | 14 | 1 | 3.6 | 1.6 | 1.69 | 5.71 | 6.74 |
| | wt. % | 84.5 | 11.9 | 3.0 | .6 | | | | | |
| 2 | at. % | 67 | 18 | 14 | 1 | 3.6 | 1.6 | 1.73 | 4.97 | 6.02 |
| | wt. % | 75.1 | 21.3 | 3.0 | .6 | | | | | |

For comparison, the compositions of some amorphous metal alloys lying outside the scope of the invention and their field annealed dc and sc measurements are listed in Table IV. These alloys, in contrast to those within the scope of the present invention, evidenced low magnetization, high core loss and high volt-ampere demand.

TABLE IV

FIELD ANNEALED DC AND AC MAGNETIC MEASUREMENTS FOR AMORPHOUS METAL ALLOYS OUTSIDE THE SCOPE OF THE INVENTION

| Example | | Composition Fe | Co | B | Si | dc $H_c$ (A/m) | $B_O$ (T) | $B_{80}$ (T) | 400 Hz ac at 1.6T Core Loss (watt/kg) | Exciting Power (VA/kg) |
|---|---|---|---|---|---|---|---|---|---|---|
| 1 | at. % | 80 | 5 | 13 | 2 | 8.0 | 1.03 | 1.34 | | >20* |
| | wt. % | 90 | 6 | 3 | 1 | | | | | |
| 2 | at. % | 60 | 25 | 14 | 1 | 4.8 | 1.59 | 1.68 | 6.02 | 8.64 |
| | wt. % | 67 | 29.4 | 3.1 | .5 | | | | | |
| 3 | at. % | 69 | 16 | 15 | 0 | 6.4 | 1.52 | 1.6 | 6.36 | 11.52 |
| | wt. % | 78.1 | 18.6 | 3.3 | 0 | | | | | |
| 4 | at. % | 74 | 10 | 16 | 0 | 4.8 | 1.31 | 1.4 | | >20* |
| | wt. % | 84.7 | 11.8 | 3.5 | 0 | | | | | |
| 5 | at. % | 80 | 5 | 14 | 1 | 5.6 | .73 | 1.04 | | >20* |
| | wt. % | 90.4 | 6.0 | 3.1 | .5 | | | | | |

*The applied voltage distorted from the sinusoidal form when sample approached saturation, preventing operation at the 1.6T induction level.

Having thus described the invention in rather full detail it will be understood that these details need not be strictly adhered to but that various changes and modifications may suggest themselves to one skilled in the art, all falling within the scope of the present invention as defined by the subjoined claims.

We claim:

1. A metal alloy which is at least 90 percent amorphous consisting essentially of a composition having the formula $Fe_aCo_bB_cSi_d$, where "a", "b", "c" and "d" are atomic percentages ranging from about 64.0 to 80.0, 7.0 to 20.0, 13.0 to 15.0 and greater than zero to 1.5, respectively, with the proviso that the sum of "a", "b", "c" and "d" equals 100.

2. An amorphous metal alloy as recited in claim 1, wherein said alloy is at least about 97 percent amorphous.

3. An amorphous metal alloy as recited in claim 1, wherein said alloy is 100 percent amorphous.

4. An amorphous metal alloy as recited in claim 1, wherein "a", "b", "c" and "d" are 67, 18, 14 and 1, respectively.

5. For use in an electromagnetic device, a core comprising a metal alloy which is at least 90 percent amorphous consisting essentially of a composition having the formula $Fe_aCo_bB_cSi_d$, wherein "a", "b", "c" and "d" are atomic percentages ranging from about 64.0 to 80.0, 7.0 to 20.0, 13.0 to 15.0 and greater than zero to 1.5, respectively, with the proviso that the sum of "a", "b", "c" and "d" equals 100.

* * * * *